US009719668B2

(12) United States Patent
Allan

(10) Patent No.: US 9,719,668 B2
(45) Date of Patent: Aug. 1, 2017

(54) ANIMATION AND GOBO FORMING MEANS FOR ILLUMINATION DEVICE

(71) Applicant: Simon Allan, Kent (GB)

(72) Inventor: Simon Allan, Kent (GB)

(73) Assignee: Martin Professional ApS, Aarhus N. (DK)

( * ) Notice: Subject to any disclaimer, the term of this patent is extended or adjusted under 35 U.S.C. 154(b) by 0 days.

(21) Appl. No.: 13/765,989

(22) Filed: Feb. 13, 2013

(65) Prior Publication Data

US 2013/0208479 A1 Aug. 15, 2013

(30) Foreign Application Priority Data

Feb. 14, 2012 (DK) ..... 201270072

(51) Int. Cl.

| | |
|---|---|
| ***F21V 17/02*** | (2006.01) |
| ***F21V 21/30*** | (2006.01) |
| ***F21S 10/00*** | (2006.01) |
| ***F21V 5/00*** | (2015.01) |
| *F21W 131/406* | (2006.01) |

(52) U.S. Cl.

CPC ..... *F21V 21/30* (2013.01); *F21S 10/007* (2013.01); *F21V 5/00* (2013.01); *F21W 2131/406* (2013.01)

(58) Field of Classification Search

CPC ..... F21S 10/007; F21W 2131/406

USPC ... 362/269, 427, 428, 16–18, 231, 277, 282, 362/283, 284, 286, 287, 293, 297, 300, 362/319, 322–324

See application file for complete search history.

(56) References Cited

U.S. PATENT DOCUMENTS

| | | | | |
|---|---|---|---|---|
| 4,914,556 | A * | 4/1990 | Richardson | 362/293 |
| 5,113,332 | A * | 5/1992 | Richardson | 362/282 |
| 5,988,835 | A * | 11/1999 | Allen | 362/324 |
| 6,309,070 | B1 * | 10/2001 | Svetliza et al. | 351/221 |
| 6,601,973 | B2 * | 8/2003 | Rasmussen et al. | 362/282 |
| 7,322,703 | B2 * | 1/2008 | Matsui | 353/84 |
| 7,736,023 | B2 * | 6/2010 | Belliveau et al. | 362/284 |

(Continued)

FOREIGN PATENT DOCUMENTS

| | | |
|---|---|---|
| WO | WO2009/062607 | 5/2009 |
| WO | WO2011119450 | 9/2011 |

OTHER PUBLICATIONS

Danish Office Action; Danish Application No. PA201270072; Dated: Oct. 16, 2012; 4 pages.

(Continued)

*Primary Examiner* — Tsion Tumebo

(74) *Attorney, Agent, or Firm* — Blank Rome LLP

(57) ABSTRACT

The present invention relates light forming means for modifying a light beam. The light forming means comprises a number of annular gobo segments arranged partially around the center of the light forming means and each of the annular gobo segments has an angular extent allowing the light beam to be enclosed by the annular gobo segment. The light forming means comprises also an annular animation segment forming an annular segment of the light forming means, wherein the angular extent of the animation segment is at least twice as big as the annular extent of at least one of the annular gobo segments. The present invention relates also to a light effect system and illumination device comprising such light forming means.

18 Claims, 3 Drawing Sheets

(56) References Cited

U.S. PATENT DOCUMENTS

| | | | | |
|---|---|---|---|---|
| 2006/0002109 | A1 | 1/2006 | Made | |
| 2009/0109680 | A1 | 4/2009 | Belliveau et al. | |
| 2010/0328626 | A1 | 12/2010 | Miyazak | |
| 2011/0249442 | A1* | 10/2011 | Jurik et al. | 362/277 |
| 2013/0094219 | A1* | 4/2013 | Jurik et al. | 362/322 |

OTHER PUBLICATIONS

Reply to First Office Action dated Oct. 16, 2012—Intention to Grant; Danish Application No. PA201270072; Dated: Dec. 7, 2012; 2 pages.

Clean version of claims; Animation and GOBO Forming Means for Illumination Device; 3 pages. Submitted with Dec. 7, 2012 Response.

Marked up version of claims; "Animation and GOBO Forming Means for Illumination Device"; 3 pages. Submitted with Dec. 7, 2012 Response.

Grant Letter; Danish Application No. PA201270072; Dated: Dec. 10, 2012; 2 pages.

European Search Report; European Application No. 13152755.8; 9 pages.

* cited by examiner

ANIMATION AND GOBO FORMING MEANS FOR ILLUMINATION DEVICE

FIELD OF THE INVENTION

The present invention relates to a light effect system for an illumination device. The light effect system is capable of modifying a light beam in order to create various light effects.

BACKGROUND OF THE INVENTION

Light fixtures creating various effects are getting more and more used in the entertainment industry in order to create various light effects and mood lighting in connection with live shows, TV shows, sport events and/or as a part on architectural installation.

Typically entertainment light fixtures create a light beam having a beam width and a divergence and can for instance be wash/flood fixtures creating a relatively wide light beam with a uniform light distribution or it can be profile fixtures adapted to project an image onto a target surface. Light effects created by rotating various types of beam modifiers such as GOBOs, prisms and frost filters with rotational point around the central axis of the light beam are widely known in the art of entertainment lighting. Animation effects where an animation like light effect is created by rotating effect wheel around a rotational point outside the light beam is also known. Framing systems where a number of framing blades can be moved in and out of the light beam are known. Most entertainment light fixtures comprise thus the same type of beam modifiers and create thus the same type of light effects.

WO2007/098764 discloses a lens system comprising at least one lens, which lens system primarily applies for use in a light assembly comprising at least one light source, which generates a beam of light into light forming means and further through a front lens. The lens system comprises at least one supplementary optical component, which supplementary optical component is moved in or out of the light beam by first actuating means, which first actuating means is moving the supplementary optical component in a rotating movement around a rotation axis from a first position outside the light beam into a second position in the light beam, which rotation axis has a direction mostly perpendicular to the light beam.

U.S. Pat. No. 6,971,770 discloses a lighting apparatus including an effect wheel which is mounted on a rotation mechanism. The rotation mechanism is mounted on a mechanism which moves the effect wheel from a position outside of the light path to a position in which the effect wheel intersects the light path to provide a continuous wheel effect. The translation mechanism can move the effect wheel between positions in which the effect wheel crosses the light path in a horizontal direction and in a vertical direction, respectively. The apparatus allows a continuous wheel effect to be added to a multi-purpose luminaire and also allows the direction of travel of the continuous wheel effect across the illuminated field to be continuously varied.

WO9636834, WO03023513, WO07134609, disclose framing systems according to prior art where a number of shutter blades surrounds the light beam and can be moved in and out of the light beam by a number of actuators.

EP 1 516 14 discloses an apparatus for shaping a light beam in a lighting device, comprising a planar occluding element arranged in a plane generally orthogonal to the axis of the light beam and a support disc disposed parallel to the occluding element, wherein the occluding element is rotatably mounted on the support disc for rotation about a first axis, parallel to the axis of the light beam and movable in a path offset from the axis of the light beam and wherein the support disc is rotatable about the axis of the light beam to move the first axis in a circular orbit about the axis of the light beam.

Light designers want as many effects as possible in a lighting apparatus as these results in many effect options when creating light shows. However it is difficult to provide lighting apparatus with many effects as each kind of effect take up space in the lighting apparatus. Especially it is difficult to provide many light effects in projecting light devices as the light forming element need to be positioned in a focal point of the optical system, and typical optical systems are only capable of focusing in a very limited area. It is thus not possible to provide light apparatus with both an effect wheel as disclosed by U.S. Pat. No. 6,971,770 and a framing system as disclosed by WO9636834, WO03023513 or WO07134609. Further light designers often want to create special and spectacular shows and there is thus a need for new light effects.

DESCRIPTION OF THE INVENTION

The object of the present invention is to solve the above described limitations related to prior art. This is achieved by a light effect system and illumination device as described in the independent claims. The dependent claims describe possible embodiments of the present invention. The advantages and benefits of the present invention are described in the detailed description of the invention.

DETAILED DESCRIPTION OF THE INVENTION

The present invention is described in view of a moving head lighting fixture including a light source generating a light beam, however the person skilled in the art realizes that the light effect system accord the present invention can be used in any kind of illumination devices and that any kind of light source such as discharge lamps, OLEDs, LED, plasma sources, halogen sources, fluorescent light sources, etc. can be used to generate the light beam.

Figure 1:
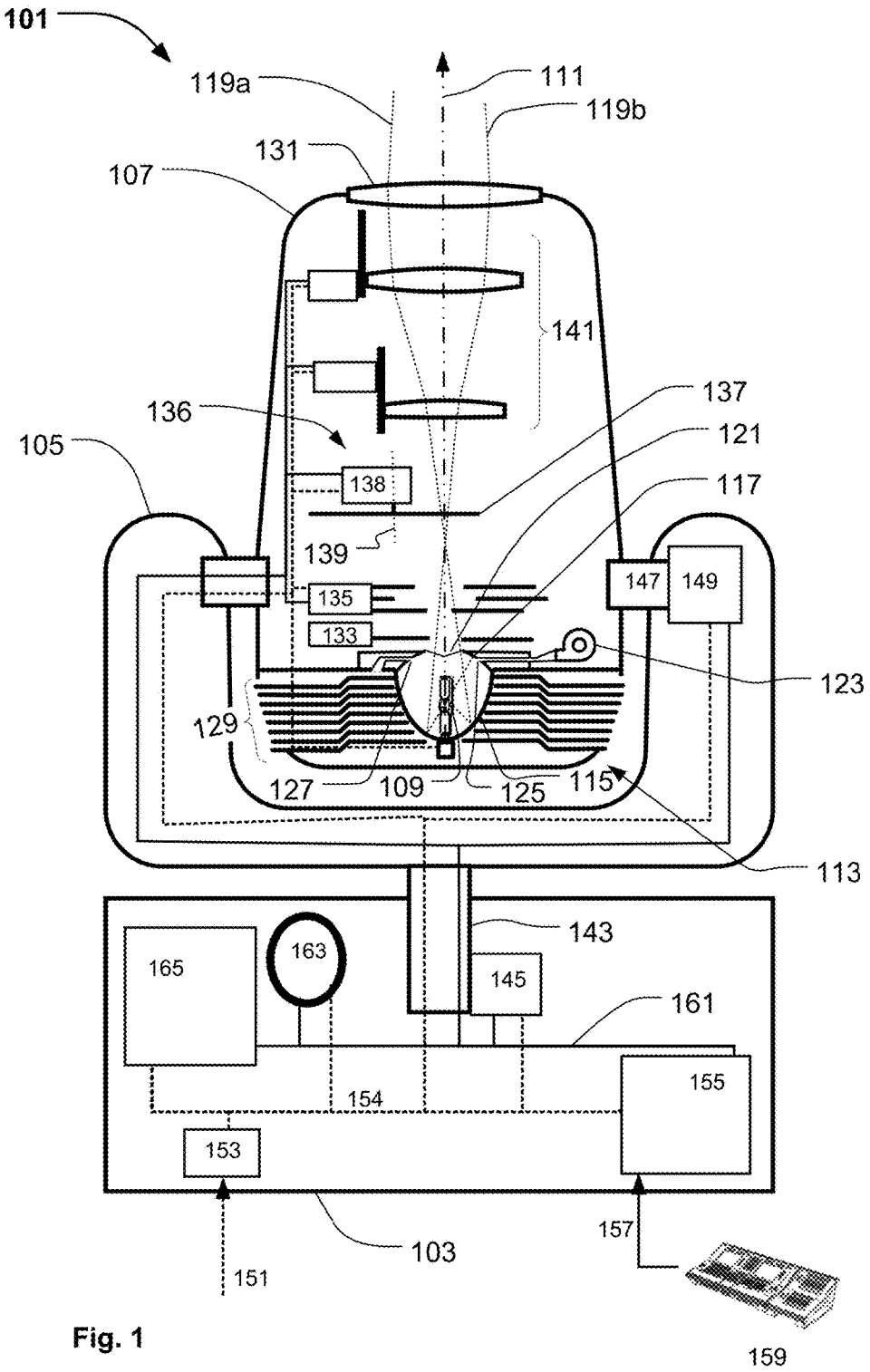
FIG. 1 illustrates a structural diagram of an illumination device wherein a light effect system according the present invention has been integrated.

FIG. 1 is a structural diagram illustrating a moving head light fixture 101 comprising a reflector and cooling system. The moving head light fixture 101 comprises a base 103 rotatable connected to a yoke 105 and a head 107 rotatable carried in the yoke. The head comprises at least one light source 109 which generates a light beam propagating along an optical axis 111.

The light source 109 is arranged in a lamp reflector and cooling system 113 comprising a main reflector 115 wherein the light source 109 is arranged and where a retro reflector 117 is arranged outside off and facing the main reflector. The retro reflector 117 has an exit aperture 121 allowing a part of the light to pass along the optical axis 111. The main reflector 115 is adapted to reflect a part of the light generated by the light source along the optical axis as illustrated by dotted line 119*a* showing a light ray which is reflected by the main reflector before it propagates along the optical axis and through the rest of the optical system which will described below. It is noted the illustrated light rays only serve to illustrate the principles of the reflectors and do not illustrate exact and precise light beams. The concave retro reflector 117 is adapted to reflect a part of the light generated by the light source back towards the main reflector and the main reflector 115 reflects the reflected light forwardly along the optical axis and through the exit aperture 121. Dotted line 119*b* shows a light ray which first is reflected by the concave retro reflector and then by the main reflector before it propagates along the optical axis and through the aperture 121. The concave retro reflector makes it possible to collect the outer part of light generated by the light source and which usually not will enter the later optical system.

The reflector and cooling system comprises also cooling means adapted to cool the light source, and the cooling means comprises a first blower 123 adapted to provide cooling air to the light source. The retro reflector comprises an air inlet 125 where through the first blower 123 blows cooling air towards the light source 109 and an air outlet 127 allowing the cooling air inside said reflector system to flow out. The main reflector is a dichroic ceramic reflector at least partially surrounded by a number of cooling fins 129. The dichroic ceramic reflector which is adapted to transmit infrared light and reflect visible light in order to remove heat form the light. The infrared light will be transmitted through the ceramic dichroic reflector and hit the cooling fins 129 where it is absorbed as heat which can be dissipated to the surroundings the cooling fins. Dichroic ceramic reflectors are fragile and may break when providing eventual inlets and/or outlets. Further spacing between the retro reflector and the main reflector can be avoided whereby more light will be reflected along the optical axis, as light loss through such spacing can be avoided.

The person skilled in the art of optics will be able to design the shape of the main reflector such the light leaving the main reflector has a predetermined divergence, for instants in order to focus the light beams through an optical gate as described below. Further the light, main reflector, retro reflector system and cooling system only serves as an illustrative example of a light engine creating a light beam and the skilled person will be able to construct other kind of light engines using a large variety of light sources.

The light is directed along the optical axis 111 by the reflector system and passes through a number of light effects before exiting the head through a front lens 131. The light effects can for instance be any light effects known in the art of intelligent lighting for instance a dimmer 133, a CMY color mixing system 135, color filters (not shown), gobos and animation effects created by a light effect system 136 according to the present inversion.

The light effect system 136 comprises light forming means 137 and an actuator 138. The light forming means 137 is adapted to be positioned in and to modify the light beam. The actuator 138 is adapted to rotate the light forming means around an axis 139 substantially parallel with the optical axis 111 of the light beam.

Figure 2:
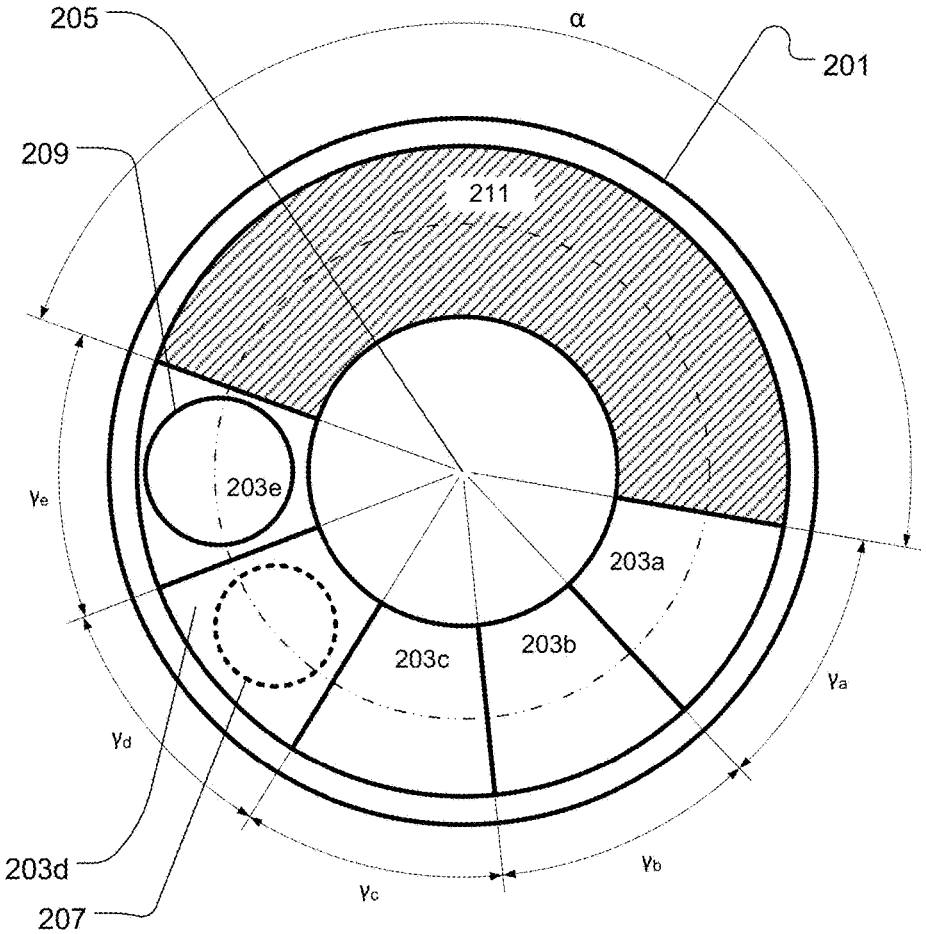
FIG. 2 illustrate light effect wheel according to the present invention.

FIG. 2 illustrates an embodiment of the light forming means according the present intention. In this embodiment the light forming means are shaped as a light effect wheel 201 comprises number of annular gobo segments 203*a*-203*e* arranged partially around the center 205 of the light effect wheel. Each the annular gobo segment has an angular extend $\gamma_a$-$\gamma_e$ allowing the light beam 207 (as dashed circle) to be enclosed by the annular gobo segment 203*a*-203*e*. For instance, in the illustrated embodiment the light beam 207 is indicated inside the annular gobo segment 203*d*. The annular gobo segments comprise a number of gobo patterns (not shown) which can be used to create various light patterns, when the annular gobo segment is positioned in the light beam. The actuator can rotate the light effect wheel and position the light different annual gobo segment in the light beam. Annular gobo segment 203*e* comprises an aperture 209 which is larger than the light beam 207 and the light beam can thus pass unmodified through the aperture.

Further the light effect wheel 201 comprises an annular animation segment 211 (illustrates as hatched area) forming an annular segment of the light forming means. The angular extend $\alpha$ of the animation segment is at least twice as big as the annular extent $\gamma_e$-$\gamma_e$ of the smallest one of said annular gobo segments. The annual animation segment 211 covers thus a larger angular area of the light effect wheel and the light effect wheel can thus be rotated in relation to the light beam while the light beam still will be keep inside the annular animation segment. The annular animation segments can thus be used to create various animation effects when the actuator rotates the light effect wheel in relation the light beam in a way where the light beam is positioned inside the annular animation segment. As a consequence interesting dynamic light patterns can be created while the light effect wheel rotates in relation to the light beam. The provided light effect systems makes is possible to reduce the space that the animation wheels and gobo wheels occupied in a illumination device, as the illustrated light effect wheel combines the animation wheels, which has animation effects all away round the center and known gobo wheels where the gobo patterns are distrusted all the way around the center of the light effect wheel. Further the illustrated light effect system makes it possible to provide both the animation effects and gobo effect in the focal point of the light beam, whereby a very sharp image of the animation patterns and gobo pattern can be provided.

The actuator can be adapted to arrange the annular animation segment in the light beam and to rotate the light forming means between a first animation position and a second animation position. Where a first part of the annual animation segment is positioned inside the light beam in the first animation position and where a second part of the annual animation segment is positioned inside the light beam in the second potion. This makes it possible to rotate the light wheel back and forth the between the first and second animation position and it can thus be avoided that the light effect wheel is rotated outside the annular animation segment. The first animation position and second animation position can for instance define the two outer most areas of the annual animation segment. The actuator can also be adapted to vary the angular velocity of rotation of the light forming means. This makes it possible to define rotation directions and speed of the light effect wheel making it possible to create varying light effects, as both speed and direction of the dynamic light patterns can be changed.

The light forming means are illustrated as a disc shaped light effect wheel, however the skilled person will realize that the outer contour of the light forming means can have any shape.

Returning now to FIG. 1 the moving head light fixture 101 comprises also a projecting system 141 capable of projecting the light beam along the optical axis 111 for instance in order to provide focus and/or zoom functions. As illustrated the light effect system 136 according to the present invention is positioned at least partial in said light beam and between said light source and said projecting system. The projecting system 141 can be adapted to provide and image of the light forming mean a distance along the optical axis whereby by a sharp image of the light forming means can be created.

Additionally the moving head light fixture can also comprise a number the light effects such as prism effects (not shown), framing effects (not shown), iris effects (not shown) or any other light effects known in the art.

The moving head light fixture comprises first rotating means for rotating the yoke in relation to the base, for instance by rotating a shaft 143 connected to the yoke by using a motor 145 positioned in the base or yoke (shown in base). The moving head light fixture comprises also second rotating means for rotating the head in relation to the yoke, for instance by rotating a shaft 147 connected to the head by using a motor 149 positioned in the yoke or head (shown in yoke). The skilled person would realize that the rotation means can be constructed in many different ways using mechanical components such as motors, shafts, gears, cables, chains, transmission systems, bearings etc.

The moving head light fixture 101 receives electrical power 151 from an external power supply (not shown). The electrical power is received by an internal power supply 153 which adapts and distributes electrical power through internal power lines 154 (dotted lines) to the subsystems of the moving head. The internal power system can be constructed in many different ways and the illustrated power lines is for simplicity illustrated as one system where all subsystems are connected to the same power line. The skilled person would however realize that some of subsystems in the moving head need different kind of power and that a ground line also can be used. The light source will for instance in most applications need a different kind of power than step motors and driver circuits.

The light fixture comprises also a controller 155 which controls the other components (other subsystems) in the light fixture based on an input signal 157 indicative light effect parameters, position parameters and other parameters related to the moving head lighting fixture. The controller receives the input signal from a light controller 159 comparing processing means, memory means and communication means, as known in the art of intelligent and entertainment lighting for instance by using a standard protocol like DMX, ArtNET, RDM etc. Typically the light effect parameter is indicative of at least one light effect parameter related to the different light effects in the light system. The central controller 155 is adapted to send commands and instructions to the different subsystems of the moving head through internal communication lines 161 (solid lines). The internal communication system can be based on a various type of communications networks/systems and the illustrated communication system is just one illustrating example.

The input signal 157 can for instance be indicative of at least one annular segment parameter being indicative of at least one of the annular gobo segments and/or the annular animation segment. This makes it possible for a user to select which of the gobo pattern, the open aperture or the animation pattern should be positioned in the light beam and the controller will thus instruct the light effect system 136 to position the chosen pattern in the light beam. In a DMX controlled system one DMX channel can be divided into a number of different intervals of DMX values (between 0-255) where one interval correspond to the corresponding gobo or animation pattern on the light effect wheel 137.

The input signal 157 can also indicative of at least one animation speed parameter being indicative of an rotation speed of the light effect means when said annular segment parameter is positioned the light beam. This makes it possible to instruct the illumination device to vary the speed of the dynamic animation effects created by the annual animation segment. The speed parameter can for instance indicative of direction and angular velocity of the light effect wheel. The input signal 157 can also be indicative of the first and second animation positions which make it potable to define in which area of the annual animation segment the light effect wheel should move.

In another embodiment the input signal 157 can be indicative of at least one animation macro, wherein the animation macro at least defines a predefined moving pattern of the annular animation segment inside said light beam. This makes it possible to define a number of predefined moving patterns which makes it possible to execute nice looking animation effects. The predefined moving patterns can for instance be a number of animation function defined as:

Smooth:

The annular animation segment is rotated in as a Triangle Wave form across is hole whole angular extent of the annular animation segment with smooth stop and reverse.

Metronome:

The annular animation segment is positioned at the center of annual animation segment, and the light effect wheel bounces (rotates) at identical angles back and forth like a music metronome. Acceleration and/or deceleration can be incorporated into the end points. Speed and angle can be adjusted corresponding speen and angel parameters.

Play FW/Fast Rewind:

The annular animation segment moves with a preset speed through the range, stops and moves backwards through the range at 3× the Play Speed. The preset speed can be adjusted by the user through a preset speed parameter.

Play Reverse/Fast Rewind:

The annular animation segment moves with a preset speed through the range, stops and moves forward through the range at 3× the Play Speed. The preset speed can be adjusted by the user through a preset speed parameter.

Interference

The annular animation segment is positioned at the center position of the range and the light effect wheel bounces with preset speed to a random position from the center position, and every bounce alternates back and forth from the center position.

Random Animation Position:

Randomly positions of the annular animation wheel, where time to next position can be defined by an additional time parameter.

Random Gobo Position

Randomly positions the different annular gobo segments in the light beam within where time to next position is can be determined by an additional time parameter Random Wheel Position:

Randomly positions the entire light effect wheel, where time to next position can be determined by a time parameter.

The instructions related to the predefined animation functions can be stored in memory means of the illumination device and the processor can be adapted to execute the relevant animation functions based on the macro parameter of the input signal.

The moving head can also have user input means enabling a user to interact directly with the moving head instead of using a light controller 159 to communicate with the moving head. The user input means 163 can for instance be bottoms, joysticks, touch pads, keyboard, mouse etc. The user input means can also be supported by a display 165 enabling the user to interact with the moving head through menu system shown on the display using the user input means 165. The display device and user input means can in one embodiment also be integrated as a touch screen.

Figure 3:
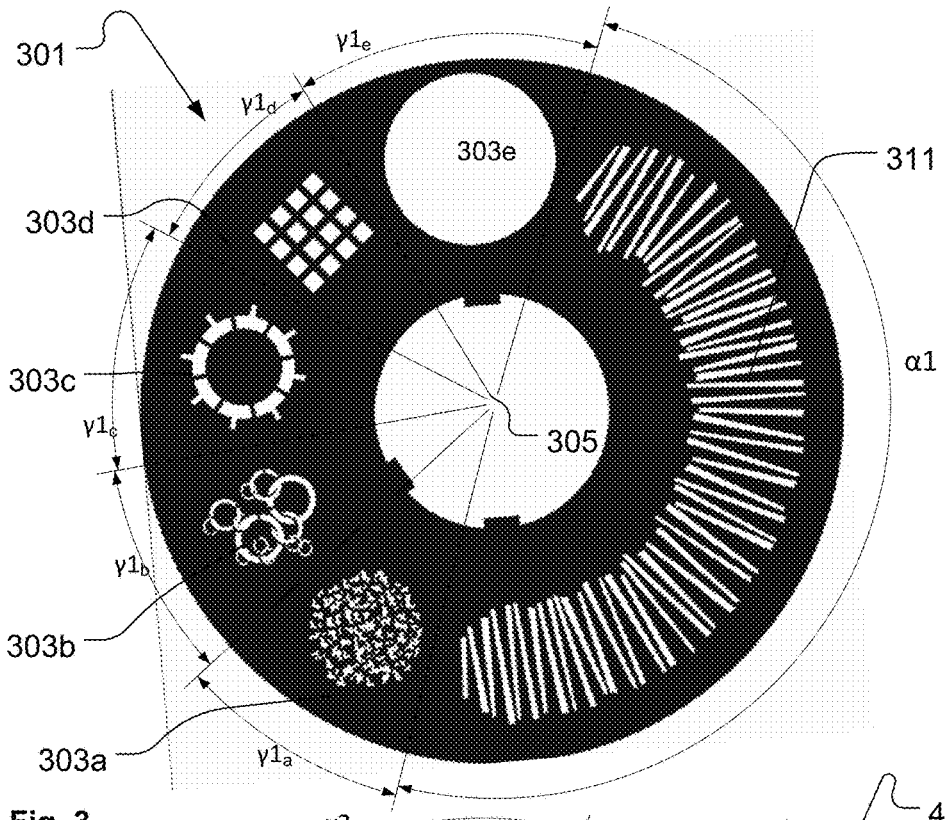
FIG. 3 illustrate another light effect wheel according to the present invention.
Figure 4:
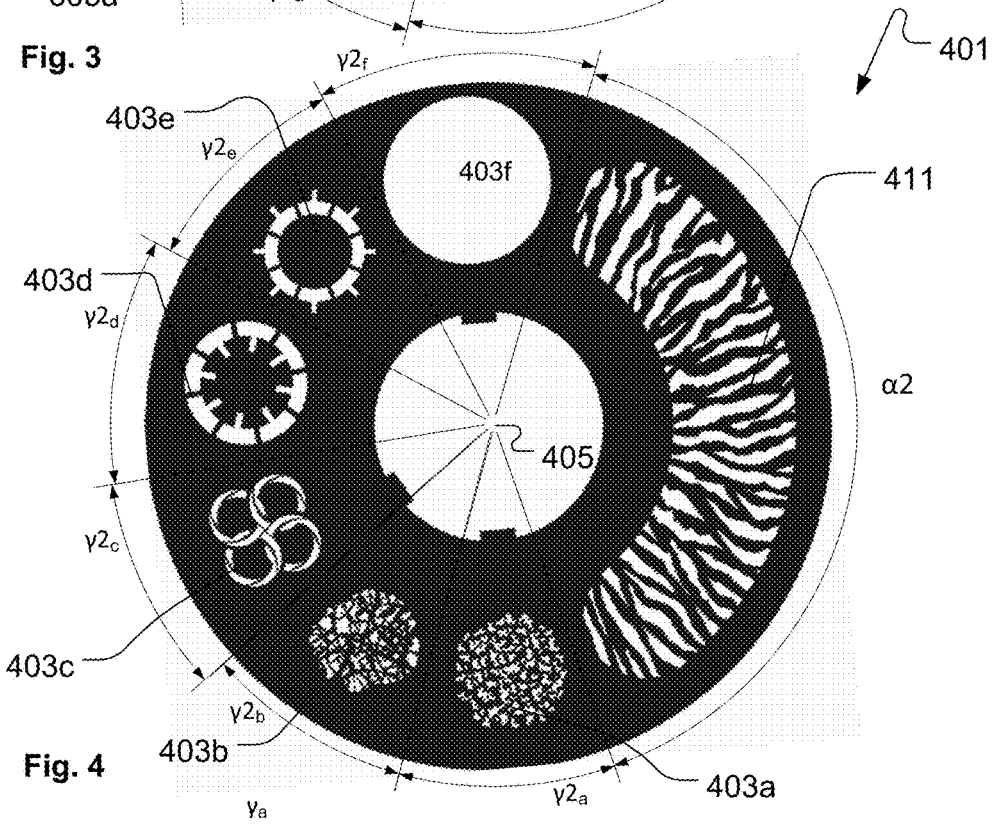
FIG. 4 illustrate another light effect wheel according to the present invention.

FIGS. 3 and 4 illustrate other embodiments of a light effect wheel according to the present invention. The light effect wheels 301 and 401 are embodied in a metal disc and the gobo patterns and animation patterns are carried out as cut outs in the metal disc.

Light effect wheel 301 comprises five annular gobo segments 303*a*-303*e* arranged partially around the center 305 of the light effect wheel. As described above the annular gobo segment has an angular extend $\gamma 1_a$-$\gamma 1_e$ allowing the light beam (not shown) to be enclosed by the annular gobo segment 303*a*-303*e*. Annular gobo segments 303*a*-303*d* comprises different gobo patterns and annular gobo segment 303*e* comprises an aperture where through the light beam can pass without being modified by the light effect wheel. The light effect wheel comprises also an annular animation segment 311 which can be used to create dynamic light patterns as described above. The annular animation segment 311 has an angular extend $\alpha 1$ being at least twice as big as smallest annual extend $\gamma 1_a$-$\gamma 1_e$ of the smallest one of the annual gobo segments 303*a*-303*e*.

Light effect wheel 401 comprises six annular gobo segments 403*a*-403*f* arranged partially around the center 405 of the light effect wheel. As described above the annular gobo segment has an angular extend $\gamma 2_a$-$\gamma 2_f$ allowing the light beam (not shown) to be enclosed by the annular gobo segment 403*a*-403*f*. Annular gobo segments 403*a*-403*e* comprises different gobo patterns and annular gobo segment 403*f* comprises an aperture where through the light beam can pass without being modified by the light effect wheel. The light effect wheel comprises also an annular animation segment 411 which can be used to create dynamic light patterns as described above. The annular animation segment 411 has an angular extend $\alpha 2$ being at least twice as big as smallest annual extend $\gamma 2_a$-$\gamma 2_e$ of the smallest one of the annual gobo segments 403*a*-403*e*.

Comparing the light effect wheel in FIGS. 3 and 4 revels that the annular extend of the annular animation segments may vary and that decreasing the size of the annular animation segment may make it possible to provide further annular gobo segments. It is also noticed that two or more annular animation segments also can be provided.

It is further to be understood that the annular gobo segment also can be provided with means for securing separate gobo to these sections, whereby it will be possible to exchange gobo shapes. It is also possible to provide means for securing rotatable gobos the annular gobo segments and in the embodiment a center sun gear for rotating the central gobos can be provide at the center of the light effect wheel. Such wheel can be embodied as known in the art.

The invention claimed is:

1. A method for forming a light beam using a light effect system, the light effect system comprising:

one light effect wheel comprising:

a number of annular gobo segments arranged partially around a center of the light effect wheel, where each of the annular gobo segments comprises a gobo pattern for creating a light pattern, and has an angular extent allowing a light beam passing therethrough to be enclosed by the annular gobo segment; and an annular animation segment, having an animation pattern, arranged around the center of the light effect wheel, configured to provide a moving pattern upon rotation of the one light effect wheel where an angular extent of the annular animation segment is at least twice as big as the annular extent of at least one of the annular gobo segments, wherein the annular gobo segments and the annular animation segment are annularly embodied about the center of the one light effect wheel, positioned so that only one respective segment can enclose the light beam at a time; and an actuator adapted to rotate the one light effect wheel about the center; where the method comprises the steps of:

receiving a light beam from a light source, the light beam propagating along an optical axis;

arranging the light effect wheel on the actuator so that an axis perpendicular to, and through the center of, the light effect wheel is parallel to the optical axis;

arranging the light effect wheel and actuator relative to the light source so that:

the light beam is completely enclosed by a respective gobo segment or by the animation segment;

a respective gobo segment or the animation segment is located in a focal point of the light beam, with no other light effect element located within the light beam; and the annular animation segment is at least twice as big as a cross section of the light beam; and rotating the light effect wheel about the center, moving the light effect wheel through the light beam, to create various gobo effects and animation effects, wherein:

gobo light patterns separate from animation patterns, and not in combination, are provided by the one light effect wheel;

both the gobo effects and animation effects are provided in the focal point of the light beam; and varying, dynamic and continuous animation effects, including moving patterns, are provided by way of rotation of the light effect wheel, while the light beam is enclosed within the annular animation segment during rotation of the light effect wheel; wherein the method further comprising the step of varying a speed of rotation of the light effect wheel about the center, wherein an angular velocity of rotation of the light effect wheel is varied between animation positions to create the varying, dynamic and continuous animation effects, where both speed and direction of the moving light patterns are changed, whereby the light effect system can define light effect wheel rotation directions and speed.

2. The method of claim 1, further comprising the step of rotating the light effect wheel back and forth about the center, between a first animation position and a second animation position, so that the annular animation segment, enclosing and moving through the light beam, provides in the first animation position a first part of the annular animation segment positioned in the light beam, and provides in the second animation position a second part of the annular animation segment positioned in the light beam, wherein the light beam continuously remains positioned in, and enclosed by, the annular animation segment during the rotation of the light effect wheel back and forth between the first and the second animation positions.

3. The method of claim 1, further comprising the step of positioning the light effect wheel in a number of annular gobo positions, where one of the annular gobo segments is positioned in, and completely encloses, the light beam in each of the number of annular gobo positions.

4. The method of claim 1, wherein one of the annular gobo segments comprises an aperture larger than the cross section of the light beam, wherein the light beam passes therethrough without modification by the light effect wheel.

5. The method of claim 1, wherein light effect system further comprises a single motor associated with the actuator, the single motor providing rotational operation of the light effect wheel.

6. The method of claim 1, wherein, in addition to arranging the light effect wheel and actuator relative to the light source, further comprising the step of:

arranging the light source within a reflector system having one or more reflectors and an exit aperture; and arranging the one or more reflectors to propagate at least part of the light beam out of the exit aperture along the optical axis of the light effect system so that:

the light beam is completely enclosed by a respective gobo segment or by the animation segment;

a respective gobo segment or the animation segment is located in a focal point of the light beam; and the annular animation segment is at least twice as big as a cross section of the light beam.

7. The method of claim 1, wherein the animation pattern of the annular animation segment is arranged thereon such that rotation of the light effect wheel in a single direction causes the animation pattern to move transversely relative to the light beam, wherein the angular extent of the annular animation segment being at least twice as big as the annular extent of at least one of the annular gobo segments, and at least twice as big as the cross section of the light beam, provides that the annular animation pattern moves entirely across the light beam during the continuing actuator rotation in the single direction.

8. A method for forming a light beam using an illumination device, the illumination device comprising:

a light source generating a light beam propagating along an optical axis of the illumination device;

a projecting system positioned along the optical axis to collect and project at least a part of the light beam; and a light effect system comprising:

one light effect wheel comprising:

a number of annular gobo segments arranged partially around a center of the light effect wheel, where each of the annular gobo segments comprises a gobo pattern for creating a light pattern, and has an angular extent allowing a light beam passing therethrough to be enclosed by the annular gobo segment; and an annular animation segment, having an animation pattern, arranged around the center of the light effect wheel, configured to provide a moving pattern upon rotation of the one light effect wheel where an angular extent of the annular animation segment is at least twice as big as the annular extent of at least one of the annular gobo segments, wherein the annular gobo segments and the annular animation segment are annularly embodied about the center of the one light effect wheel, positioned so that only one respective segment can enclose the light beam at a time; and an actuator adapted to rotate the one light effect wheel about the center; where the method comprises the steps of:

arranging the light effect wheel on the actuator so that an axis perpendicular to, and through the center of, the light effect wheel is parallel to the optical axis; arranging the light effect wheel and actuator relative to the light source so that:

the light beam is completely enclosed by a respective gobo segment or by the animation segment;

a respective gobo segment or the animation segment is located in a focal point of the light beam, with no other light effect element located within the light beam; and the annular animation segment is at least twice as big as a cross section of the light beam; and rotating the light effect wheel about the center, moving the light effect wheel through the light beam, to create various gobo effects and animation effects, wherein:

gobo light patterns separate from animation patterns, and not in combination, are provided by the one light effect wheel;

both the gobo effects and animation effects are provided in the focal point of the light beam; and varying, dynamic and continuous animation effects, including moving patterns, are provided by way of rotation of the light effect wheel, while the light beam is enclosed within the annular animation segment during rotation of the light effect wheel; wherein the method further comprising the step of varying a speed of rotation of the light effect wheel about the center, wherein an angular velocity of rotation of the light effect wheel is varied between animation positions to create the varying, dynamic and continuous animation effects, where both speed and direction of the moving light patterns are changed, whereby the light effect system can define light effect wheel rotation directions and speed.

9. The method of claim 8, further comprising the step of rotating the light effect wheel back and forth about the center, between a first animation position and a second animation position, so that the annular animation segment, enclosing and moving through the light beam, provides in the first animation position a first part of the annular animation segment positioned in the light beam, and provides in the second animation position a second part of the annular animation segment positioned in the light beam, wherein the light beam continuously remains positioned in, and enclosed by, the annular animation segment during the rotation of the light effect wheel back and forth between the first and the second animation positions.

10. The method of claim 8, wherein one of the annular gobo segments comprises an aperture larger than the cross section of the light beam, wherein the light beam passes therethrough without modification by the light effect wheel.

11. The method of claim 8, wherein, in addition to arranging the light effect wheel and actuator relative to the light source, further comprising the step of:

arranging the light source within a reflector system having one or more reflectors and an exit aperture; and arranging the one or more reflectors to propagate at least part of the light beam out of the exit aperture along the optical axis of the light effect system so that:

the light beam is completely enclosed by a respective gobo segment or by the animation segment;

a respective gobo segment or the animation segment is located in a focal point of the light beam; and the annular animation segment is at least twice as big as a cross section of the light beam.

12. The method of claim 8, wherein the animation pattern of the annular animation segment is arranged thereon such that rotation of the light effect wheel in a single direction causes the animation pattern to move transversely relative to the light beam, wherein the angular extent of the annular animation segment being at least twice as big as the annular extent of at least one of the annular gobo segments, and at least twice as big as the cross section of the light beam, provides that the annular animation pattern moves entirely across the light beam during the continuing actuator rotation in the single direction.

13. The method of claim 8, further comprising the step of adapting the projecting system to image at least a part of the light effect system at a target surface positioned a distance along the optical axis.

14. The method of claim 8, wherein the illumination device further comprises:

a communication system that receives an input signal; and a processor to control the light effect system based on the input signal.

15. The method of claim 8, wherein the input signal is indicative of at least one annular segment parameter, the annular segment parameter being indicative of at least one of the annular gobo segments or the annular animation segment.

16. The method of claim 15, wherein the input signal is indicative of at least one animation speed parameter, the animation speed parameter being indicative of a rotation speed of the light effect wheel.

17. The method of claim 8, wherein the input signal is indicative of at least one animation function, the animation function defining a predefined moving pattern of the annular animation segment inside the light beam.

18. The method of claim 8, wherein the illumination device further comprises:

a base, a yoke rotatably connected to the base, a head rotatably connected to the yoke, where the head comprises the light source, the light effect system and the projecting system.

* * * * *